US006467933B2

(12) United States Patent
Baar

(10) Patent No.: US 6,467,933 B2
(45) **Date of Patent: *Oct. 22, 2002**

(54) MEANS AND METHOD OF INCREASING LIFETIME OF FLUORESCENT LAMPS

(76) Inventor: Raymond P. Baar, P.O. Box 754 W7949 E. Townline Rd., Wautoma, WI (US) 54982

( * ) Notice: Subject to any disclaimer, the term of this patent is extended or adjusted under 35 U.S.C. 154(b) by 0 days.

This patent is subject to a terminal disclaimer.

(21) Appl. No.: 09/845,621

(22) Filed: Apr. 30, 2001

(65) Prior Publication Data

US 2001/0015894 A1 Aug. 23, 2001

Related U.S. Application Data

(63) Continuation of application No. 09/507,444, filed on Feb. 19, 2000, now Pat. No. 6,257,735.

(51) Int. Cl.[7] ..... F21V 7/09

(52) U.S. Cl. ..... 362/260; 362/241; 362/346; 362/217

(58) Field of Search ..... 362/217, 260, 362/346, 298, 301, 341, 360, 296, 241; 315/312, 324

(56) References Cited

U.S. PATENT DOCUMENTS

| | | | |
|---|---|---|---|
| 3,125,301 | A | 3/1964 | Stotter |
| 3,310,672 | A | 3/1967 | Bursell |
| 3,329,812 | A | 7/1967 | Harling |
| 3,643,088 | A | 2/1972 | Osteen et al. |
| 3,711,702 | A | 1/1973 | Adra |
| 3,735,329 | A | 5/1973 | Funabaski et al. |
| 4,347,554 | A | 8/1982 | Matsushita |
| 4,367,417 | A | 1/1983 | Casasanta |
| 4,410,932 | A | 10/1983 | Oster |
| 4,453,203 | A | 6/1984 | Pate |
| 4,520,436 | A | 5/1985 | McNair et al. |
| 4,595,969 | A | 6/1986 | McNair |
| 4,669,033 | A | 5/1987 | Lee |
| 4,704,664 | A | 11/1987 | McNair |
| 4,719,546 | A | 1/1988 | Spitz |
| 4,750,096 | A | 6/1988 | Lim |
| 4,802,073 | A | 1/1989 | Plumly |

(List continued on next page.)

FOREIGN PATENT DOCUMENTS

| | | |
|---|---|---|
| DE | 945777 | 7/1956 |
| EP | 0 151 850 A2 | 8/1985 |
| FR | 1085180 | 1/1955 |
| GB | 878534 | 10/1961 |
| JP | 4075204 | 10/1992 |

OTHER PUBLICATIONS

Aisleliter for Hi/Low Bay Applications Visit Website at: http://www.sportlite.com/aisleliter–series.htm.

*Primary Examiner*—Sandra O'Shea
*Assistant Examiner*—Hargobird S. Sawhney
(74) *Attorney, Agent, or Firm*—Schroeder & Siegfried, P.A.

(57) ABSTRACT

An elongated light fixture configured to create patterns of light saturation which is free of shadows and spots and provides a more uniform light distribution while effecting a substantial saving in energy costs when a plurality thereof are disposed at prescribed locations and elevations. In addition, such a plurality of light fixtures will produce a higher ratio of vertical to horizontal illuminance where vertical surfaces are needed to be amply lighted. The elongated fixture is characterized by its U-shaped cross-sectional configuration which has an interior light-reflective surface comprised of a plurality of elongated parallel panels which are interconnected and extend at a prescribed angle to each other. The fixtures are also claimed in combination with a hybrid magnetic-electronic ballast to provide the above advantages.

11 Claims, 8 Drawing Sheets

U.S. PATENT DOCUMENTS 4,885,668 A 12/1989 Maglica et al.
4,922,393 A 5/1990 McNair
5,113,320 A 5/1992 Haydu
5,197,798 A 3/1993 Tickner
5,216,332 A * 6/1993 Nilssen ..... 315/106
5,355,290 A 10/1994 Tickner
5,377,086 A 12/1994 Tickner
5,498,924 A * 3/1996 Northrop ..... 313/484
6,257,735 B1 * 7/2001 Baar ..... 362/217

* cited by examiner

MEANS AND METHOD OF INCREASING LIFETIME OF FLUORESCENT LAMPS

CROSS-REFERENCE TO RELATED APPLICATIONS

The instant application is a continuation of application Ser. No. 09/507,444, filed Feb. 19, 2000 now U.S. Pat. No. 6,257,735.

BACKGROUND OF THE INVENTION

Lighting designers pay a great deal of attention to the quality of the lighting provided, expressed in horizontal foot-candles. Too often they fail to bear in mind the fact that the objects of primary attention are viewed from the side and, consequently, are seen primarily or only in a vertical plane. For example, in a sports arena, a moving ball, or players, may be seen from the side, primarily. Therefore, the light levels in a generally vertical plane are very important, but are generally inadequately lighted.

Despite the above being fairly obvious, it is most common today to mount the High Intensity Discharge Bulbs (HID(s)) so that the vast majority of the light descends to the floor, and a relatively small amount of the light strikes the vertical surfaces such as are commonly found in warehouses, sports arenas, supermarkets, etc. I have designed a new reflector which produces a higher ratio of vertical to horizontal illuminance, and which yields improved overall visibility in situations where vertical surfaces are of substantial importance. As a result both lighting performance and increased safety are provided, and the lighting is free from shadows and hot spots. The lighting equipment available heretofore has been inefficient and non-cost-effective. In addition, it has been non-uniform.

Conventional high intensity discharge (HID) installations at industrial locations require great wattage. Consequently, fluorescent lighting for expansive areas has been adopted widely because of its marked efficiency, as compared to incandescent lighting. The use of such lighting, however, has been plagued with the early burning-out of the fluorescent bulbs, particularly when they are first energized. Such installations are commonly energized through an electronic-only ballast, and that combination has proved to be very economical, except for the heavy burn-out losses of the lamps. Thus, a need exists for some way of substantially reducing the early burning-out of such lamp installations.

BRIEF SUMMARY OF THE INVENTION

The primary feature of my invention is the interior reflective surface of the inverted U-shaped channel member which is characterized by the use of a series of elongated flat reflective panels extending lengthwise of the channel member in parallel side by side relation, and at a prescribed angle thereto. These panels have a reflective inner surface, facing downwardly and outwardly, and extend at an angle of about 22–32° relative to each other. They function to spread the light which they reflect downwardly so as to overlap each other's reflections markedly, and thereby diffuse the light and spread it to make it more uniform and avoid the formation of shadows and hot spots, while improving the visibility and producing a higher ratio of vertical to horizontal illuminance.

After years of experimenting, I have discovered a way of substantially reducing the number of burned-out fluorescent lamps while accomplishing a substantial saving and increasing the quantity of light. I have found that if the wattage which is passed through the fluorescent lamp is substantially reduced, the burning-out rate is also substantially reduced. I believe this improvement occurs if the lamp filament is subjected to a lesser current initially, as upon lighting. In the current use of fluorescent lamps, it has been conventional to utilize an electronic-only ballast, which does not provide the cushioning of the filament which I believe may be required, if the rate of burning-out is to be reduced. I have discovered that if a hybrid magnetic-electronic ballast is utilized to power the bulbs, the wattage required to energize a 55 watt fluorescent bulb can be reduced from the conventional approximately 300 watts, to 206 watts, which constitutes a substantial savings. In addition, the rate of burn-outs of the fluorescent lamps is substantially reduced, and the resultant lighting is increased about three (3) foot-candles. I find that I can increase the efficiency of the lighting system by 10% and improve its cost-effectiveness by 35%–70%.

I believe some of the improved performance described above is accomplished by the use of a transformer within the ballast, in combination with the conventional features of a purely electronic ballast, the latter of which is what is commonly utilized in fluorescent industrial lighting installations. I believe that the transformer, by being inserted into the prior conventional circuit leading into the 55 watt fluorescent bulb, has a stabilizing effect upon the current which is delivered to the fluorescent bulb filament, I believe that this stabilizing effect is provided as a result of the transformer removing substantial fluctuations in the current, and that it has been these fluctuations which have caused the filaments of such fluorescent bulbs to burn-out prematurely.

Thus, it is an object of my invention to provide a light reflector of improved construction to effect a substantial improvement in quality of light reflected thereby.

It is another object of my invention to furnish an improved light reflector which is designed to provide lumen saturation so as to eliminate shadows and hot spots.

Another object is to furnish a light reflector configuration and placement which provides increased foot-candle readings at any single point in the work plane into which its reflected light is directed.

Another object of my invention is to provide a light reflector configured and positioned to produce a more uniform light distribution.

Another object is to provide a lighting installation which will operate at a substantial savings, in that it burns substantially less wattage.

Another object is to furnish a light reflector configured and positioned to provide a great lumen overlap, resulting in excellent foot-candle ratings and improved uniformity in light distribution.

These and other objects and advantages of the invention will more fully appear from the following description, made in connection with the accompanying drawings, wherein like reference characters refer to the same or similar parts throughout the several views, and in which:

DETAILED DESCRIPTION OF THE INVENTION

Figure 7:
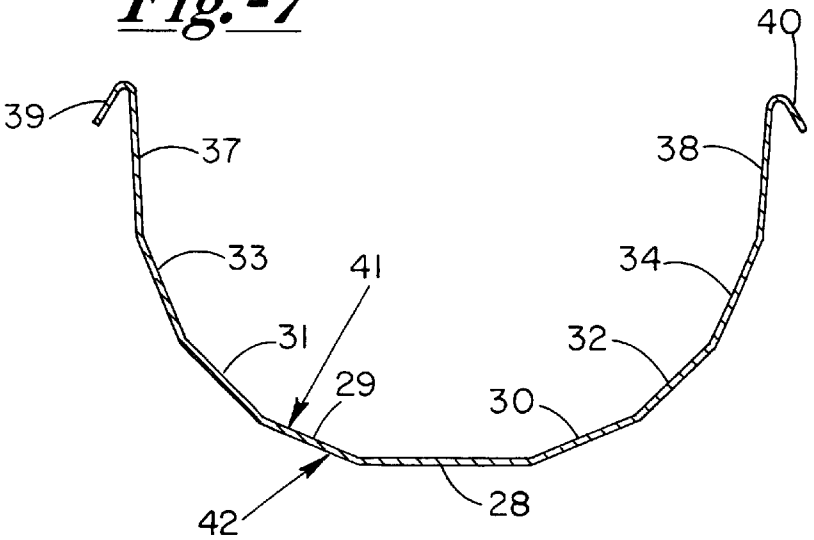
FIG. 7 is a cross-sectional view of a slightly modified form of the light reflector shown in FIG. 6.
Figure 8:
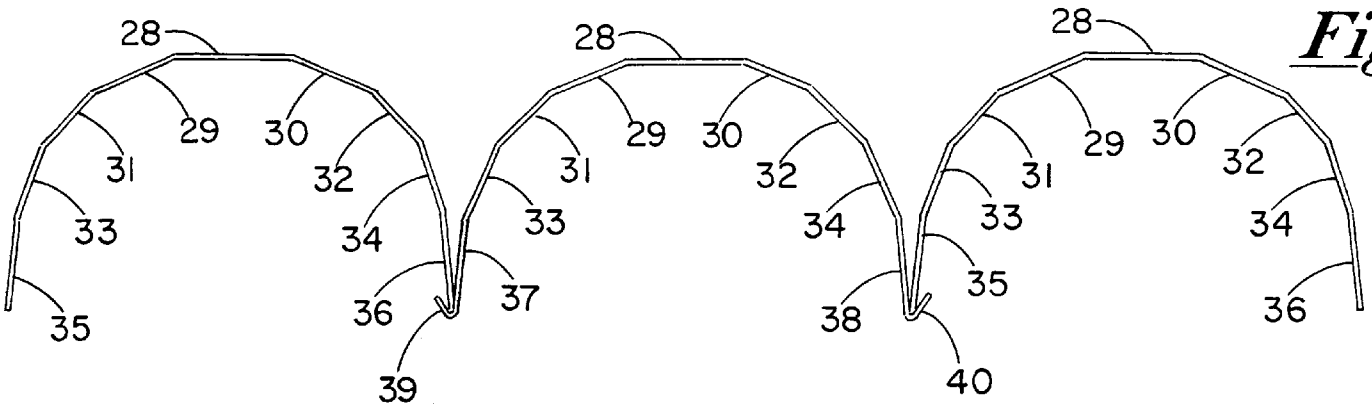
FIG. 8 is a cross-sectional view of a bank of three (3) of my light reflectors, illustrating how the reflector shown in FIG. 7 supports one side of two (2) of my reflectors, such as are shown in FIG. 6, when the reflectors are assembled in a bank of reflectors.
Figure 9:
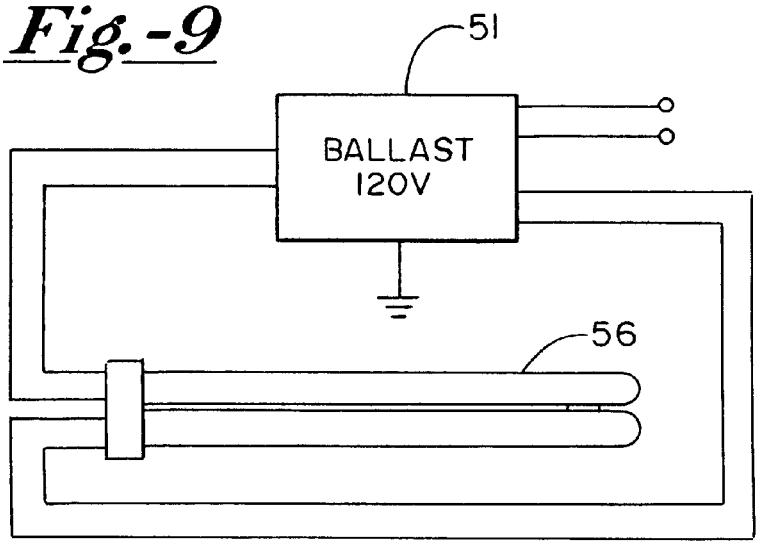
FIG. 9 shows a block diagrammatic circuit of a single 55 watt fluorescent bulb electrically connected to a 120V ballast which delivers 41.2 wattage to the bulb.
Figure 10:
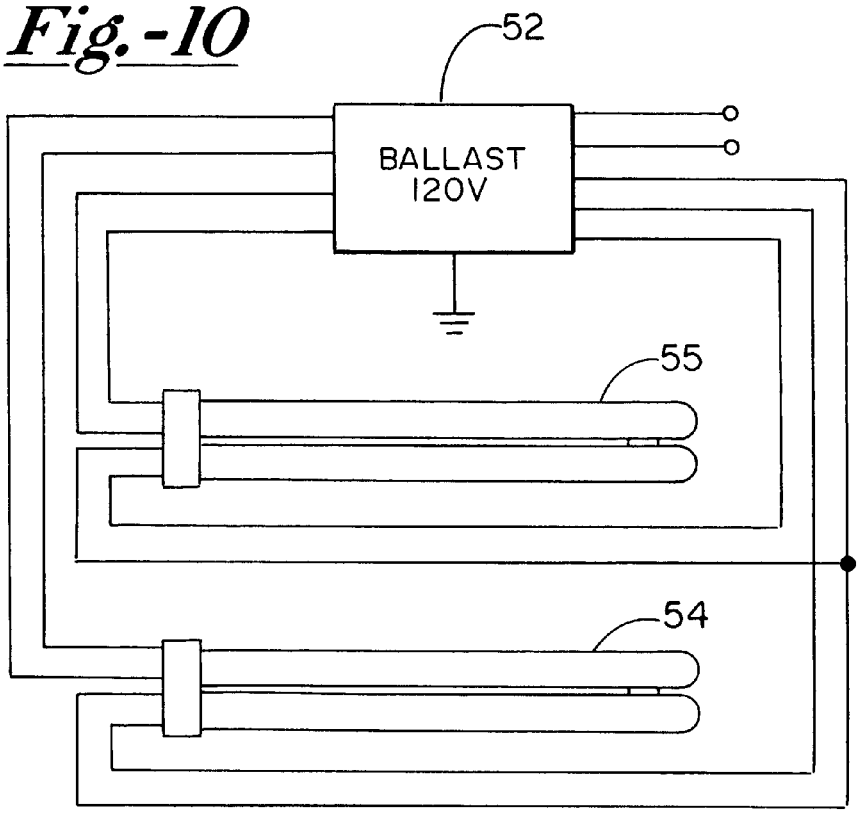
FIG. 10 shows a block diagrammatic circuit of two (2) 55 watt fluorescent bulbs connected to a 120V ballast which delivers 41.2 wattage to each of the two (2) fluorescent bulbs.
Figure 11:
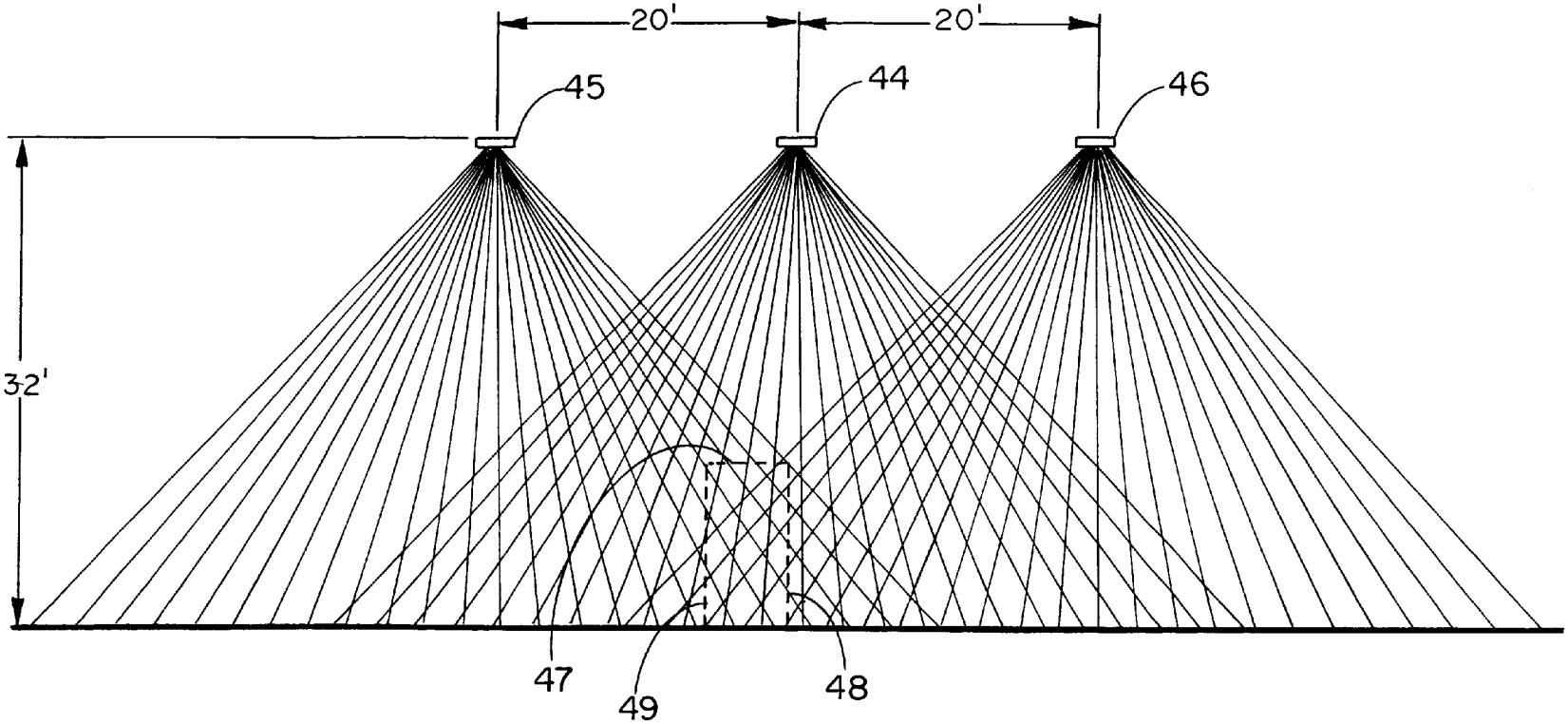
FIG. 11 is a diagrammatic view of three (3) banks of five (5) fluorescent bulbs mounted at a prescribed spacing of twenty (20) feet center to center and at an elevation of thirty-two (32) feet, illustrating the improved uniformity of lighting and increased lighting of vertical surfaces provided thereby.

The details of the construction of my light reflector are shown in FIGS. 5–8, inclusive. The details of the mounting of a single bank of said reflectors, with and without the Panasonic lamps therewithin, are shown in FIGS. 1–4, inclusive. Block diagrams of the electrical circuits supplying power to the lamps or bulbs of each bank are shown in FIGS. 9–10, inclusive. FIG. 11 shows diagrammatically the uniformity of light provided by three (3) adjacent banks of my reflectors, the overlapping of the light emanating therefrom to prevent spots and shadows, and the improved lighting of vertical surfaces provided thereby.

Figure 1:
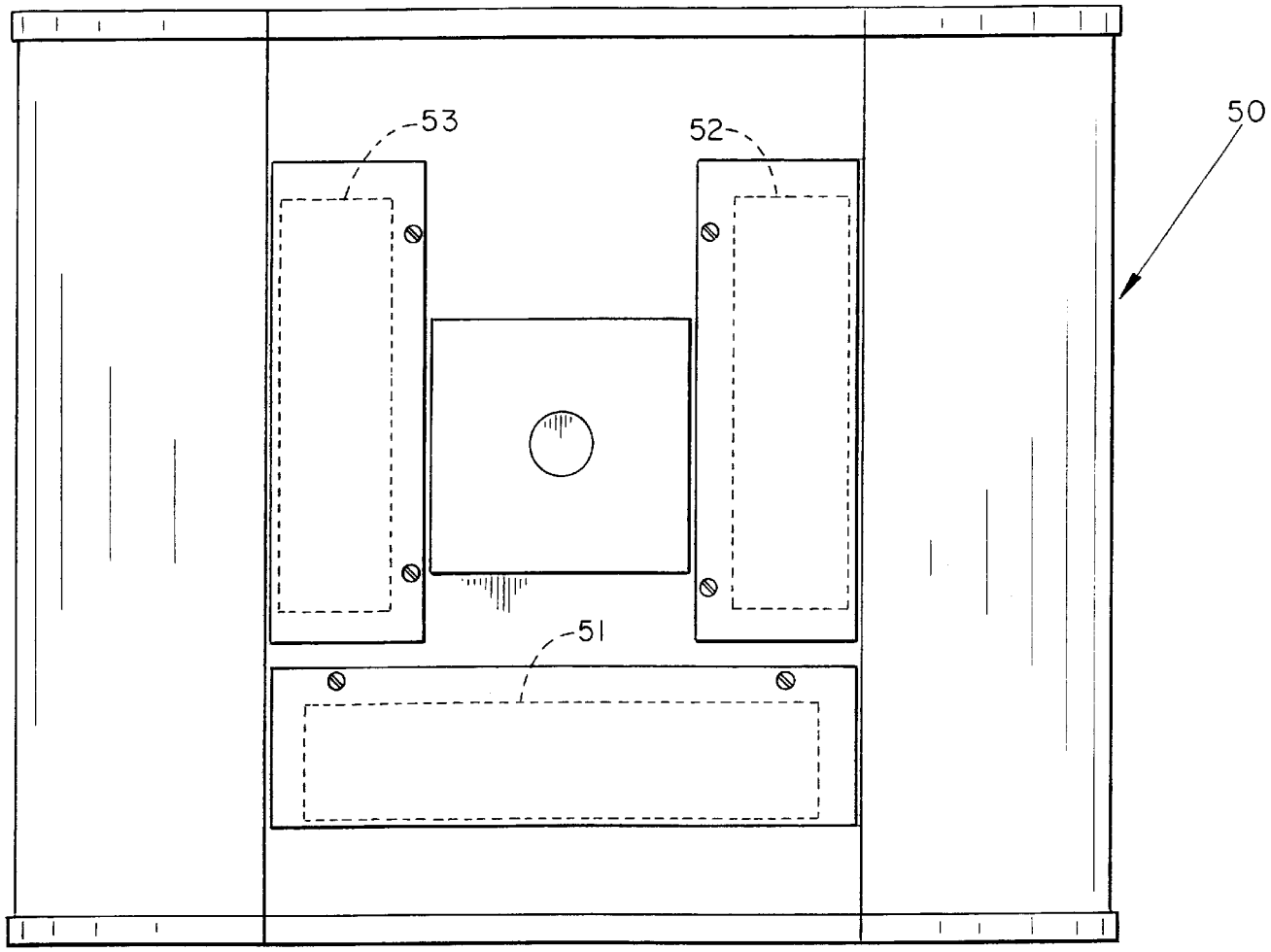
FIG. 1 is a top plan view of one of my new light reflectors.
Figure 2:
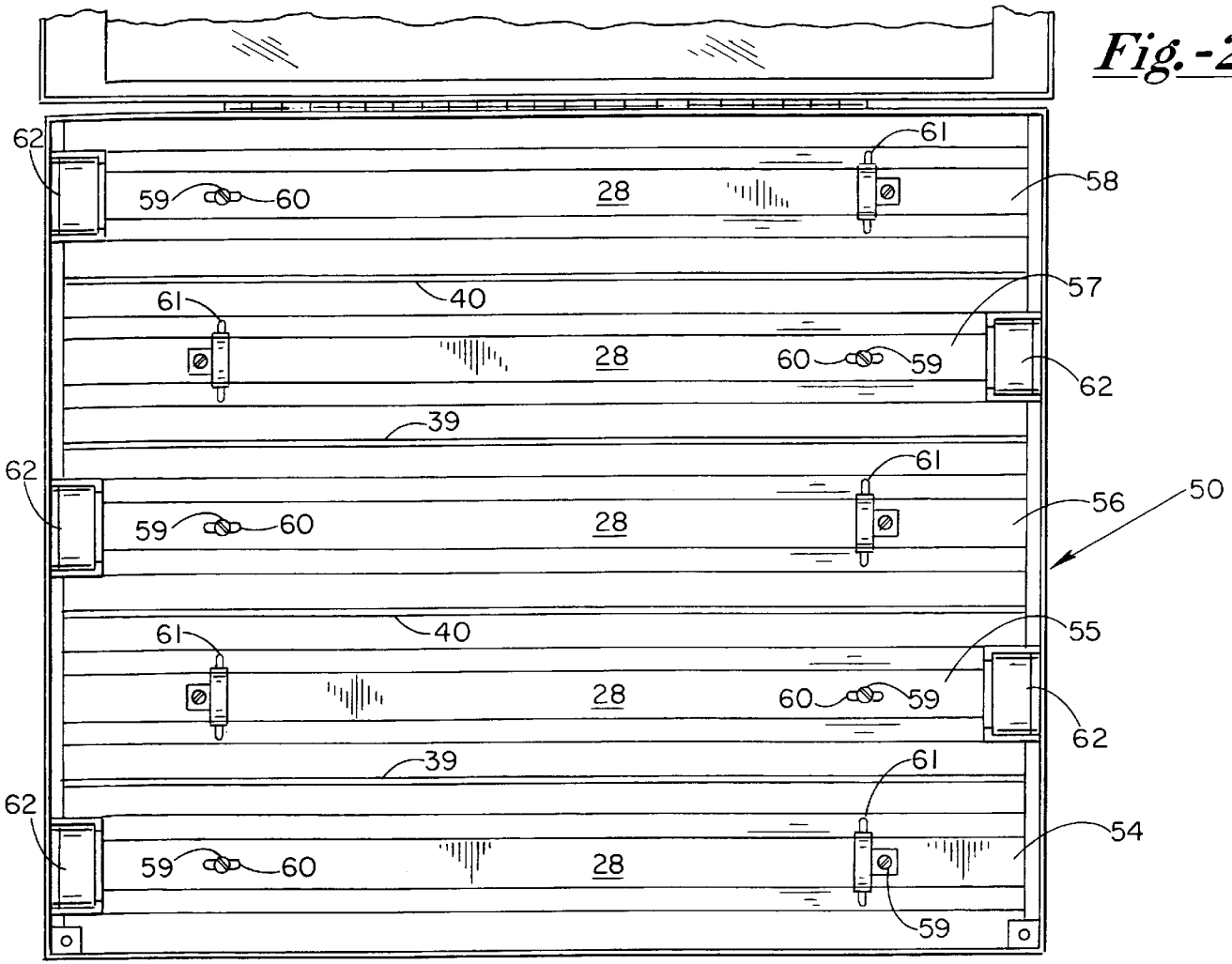
FIG. 2 is a bottom plan view of a bank of my new light reflectors, without the lamps mounted therewith.

As shown in FIG. 1–4, one of the banks of our reflectors includes a generally rectangular metal frame 50 which is equipped with a plurality of electrical connectors which supply electric current of 41.2 wattage to each of the 55 watt Panasonic fluorescent bulbs. FIG. 1, a top plan view, shows in broken lines the orientation of the three (3) ballasts which are utilized to supply electrical current to the lamps. One of said ballasts, 51, provides electrical power to the middle bulb 56. The ballast 52 supplies power to the two (2) bulbs 54 and 55 adjacent one end of the frame 50, while ballast 53 provides current to the two (2) bulbs 57 and 58 adjacent the other end of the frame 50. When used in an extensive lighting installation; each of the above bulbs is mounted within one of the five (5) reflectors, such as shown in FIG. 5–8, by means of a electrical connector 62, such as is shown in FIG. 2.

Figure 5:
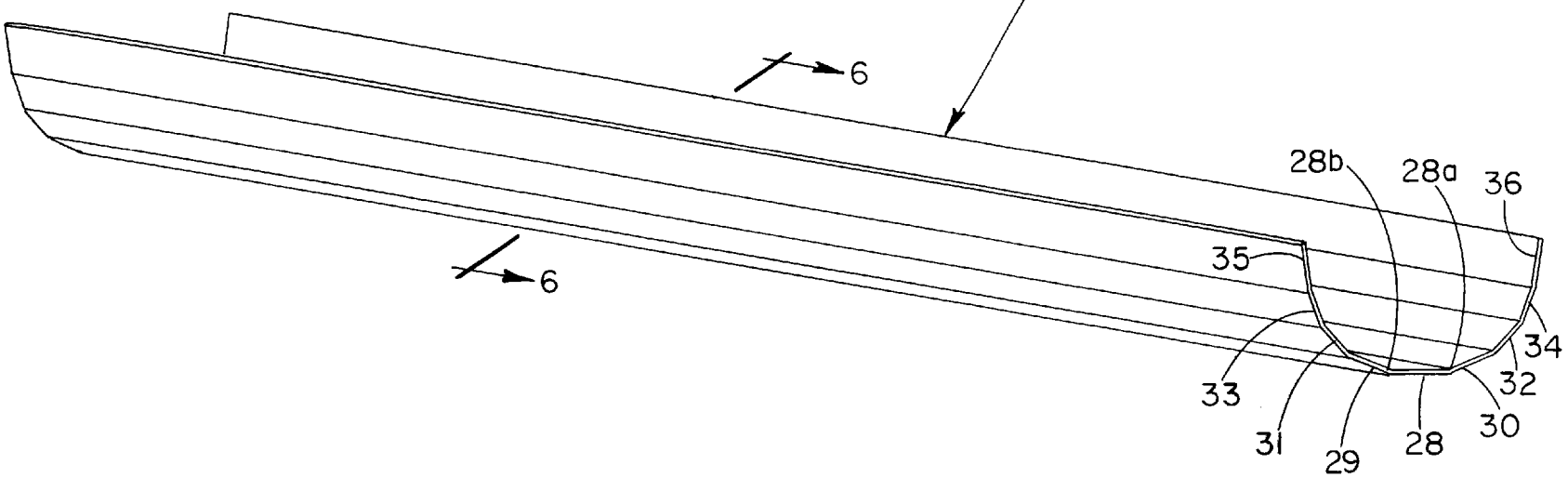
FIG. 5 is a perspective view of one of my new light reflectors.
Figure 6:
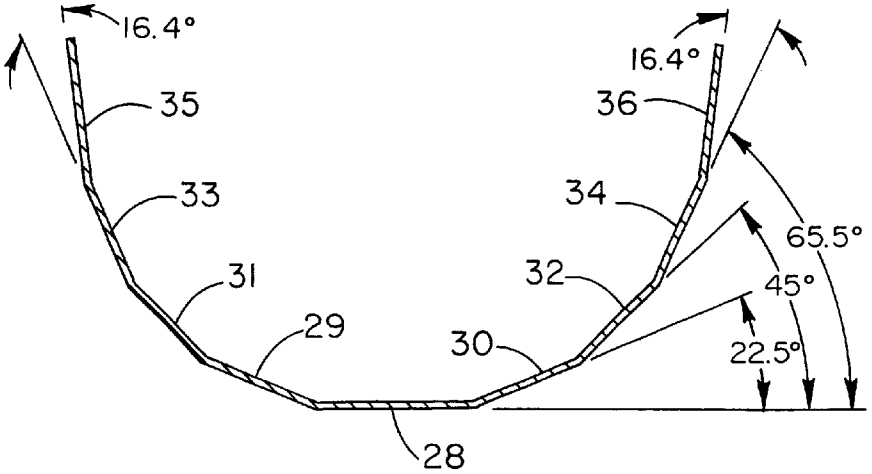
FIG. 6 is a cross-sectional view of one of my new light reflectors, taken along line 6—6 of FIG. 5.

FIG. 5 shows a perspective view of one of my reflectors and FIG. 6 shows a cross-sectional view thereof, taken along line 6—6 of FIG. 5. As shown, it is comprised of an elongated channel member 27 which is of generally U-shape in cross-sectional configuration and is made of a light metal such as aluminum. As shown, it is comprised of an elongated flat panel 28 at the base of the U-shaped channel which extends thereat through its length. It is preferably about 1 inch in width and, when in use, is fixedly secured to the frame 55 and has a reflective surface extending in a downwardly facing position.

Extending parallel to the side edges 28*a* and 28*b* of the panel 28 and connected thereto as a continuation of panel 28, is a pair of flat parallel elongated reflective panels 29 and 30, each of which extends at an angle of 22–32 degrees (preferably 22.5°) to the plane of panel 28. The reflective surfaces of each of the panels 29 and 30 face downwardly and outwardly and cooperate with the reflective surface of panel 28.

Connected and extending parallel to the side edges of the panels 29 and 30 is a second pair of flat, parallel elongated reflective panels 31 and 32, each of which has a reflective surface facing downwardly and extending outwardly from panels 29 and 30, respectively at an angle of 22–32 degrees (preferably 22.5°).

Connected and extending parallel to the side edges of panels 21 and 32 is a third pair of flat, elongated parallel reflector panels 33 and 34, each of which also has a reflective surface facing downwardly and extending outwardly from the side edges of flat panels, 31 and 32, respectively at an angle of 22–32 degrees (preferably 22.5°).

Connected and extending at their side edges to the side edges of the panels 33 and 34 is a fourth pair of flat parallel elongated panels 35 and 36, each of which also has a reflective surface facing downwardly and outwardly from the side edges of panels 33 and 34, respectively, at an angle of approximately 13–20° (preferably 16°).

Each of the panels 29–34 are preferably 11/16 of an inch wide, while the panels 35–36 may be slightly wider, preferably at 13/16 of an inch.

FIG. 7 shows a slightly modified reflector, as compared to FIG. 6, the only difference being the panels 37 and 38 and the terminal hanger portions 39 and 40. The other panels are constructed in the same size, shape, and angles as the panels 29–34. The panels 37 and 38 extend at an angle of about 13–19° (preferably 16°) to the panels 33 and 34. The terminal hanger portions 39–40 of the reflector 42 shown in FIG. 7 functions to receive one free edge of each of two (2) adjacent reflectors such as shown in FIG. 6, in supporting relation as shown in FIG. 8.

FIG. 11 illustrates the benefits derived from the use of my reflectors which are described above. The angled panels spread out the light generated by each of the bulbs mounted in each reflector of the various banks of lamps, each bank being comprised of five (5) reflectors and five (5) lamps or bulbs. These banks are spaced from each other by a distance of about twenty (20) feet, center to center, and are each disposed at an elevation of approximately 32 feet. As shown in FIG. 11, there is substantial spread and, as a consequence, there is substantial overlap of the lighting from each adjacent bank of lights. As shown, each bank such as centrally located bank 44 overlaps in excess of 50% of the area lighted by each adjacent bank, such as banks 45 and 46. Thus, bank 44 overlaps over 50% of the lighted areas of four (4) adjacent banks when we install the banks in a horizontal square design, spaced twenty (20) feet, center to center at an elevation of thirty-two (32) feet. This provides great lumen overlap and much more uniform light distribution and precludes any problem of spots and shadows, while greatly diminishing the required wattage, as hereinafter described. We find that the foot-candle readings at any single point in the work plane computational area remain consistent, due to the lumen contribution from a large number of adjacent fixtures.

Shown in broken lines, as at 47 in FIG. 11, is a figure having a vertical surface 48 which receives much more light because of the overlap of lighting from the adjacent bank 46 of fluorescent bulbs. The opposite vertical surface 49 receives a substantial amount of overlap light from the adjacent bank 45. Such overlapping and its benefits are not obtainable with conventional previously known lighting wherein most of the lighting is projected onto the floor, but little strikes the vertical surfaces. Thus, the above disposition of the bulbs in combination with new reflectors produces a higher ratio of vertical to horizontal illuminance, providing improved overall visibility where vision of vertical surfaces are important. Both lighting performances and increased safety are provided by this lighting arrangement.

FIG. 1 shows a top plan view of a five (5) bulb bank of fluorescent bulbs which includes five (5) of the reflectors described herein and ballasts for energizing same. As shown it includes a metal frame 50, a ballast 51 for the centrally disposed bulb, and two (2) ballasts 52 and 53, each electrically connected to a set of two (2) bulbs disposed at opposite ends of the frame.

FIG. 2 shows the frame 50 from the bottom and without the bulbs mounted therein. As shown, it includes a plurality of downwardly facing, inverted-U-shaped reflectors constructed as described hereinabove, identified by the numerals 54–58, inclusive. It can be seen that the reflectors are secured within the frame 50 via screws such as are identified generally by the numeral 59, which extend through slots identified generally by the numeral 60. The screws 59 extend through the slots 60 into the frame 50. At alternating ends of the U-shaped reflectors, the screws 59 also extend through the base of a depending bulb clamp such as designated generally by the numeral 61. At the end opposite the clamps, there is an electrical connector receptacle generally identified as 62, for one of the Panasonic lamps, which is mounted on the sidewall of frame 50, and is electrically connected to a ballast as hereinafter described. The receptacles 62 are each electrically connected to one of the current supplying ballasts and are of the horizontal screw mount type, model number PTP-014 which can be purchased of Etlin-Daniels, 1850 Wilson Avenue, Toronto, Ontario, Canada, M9M-1A1.

Figure 3:
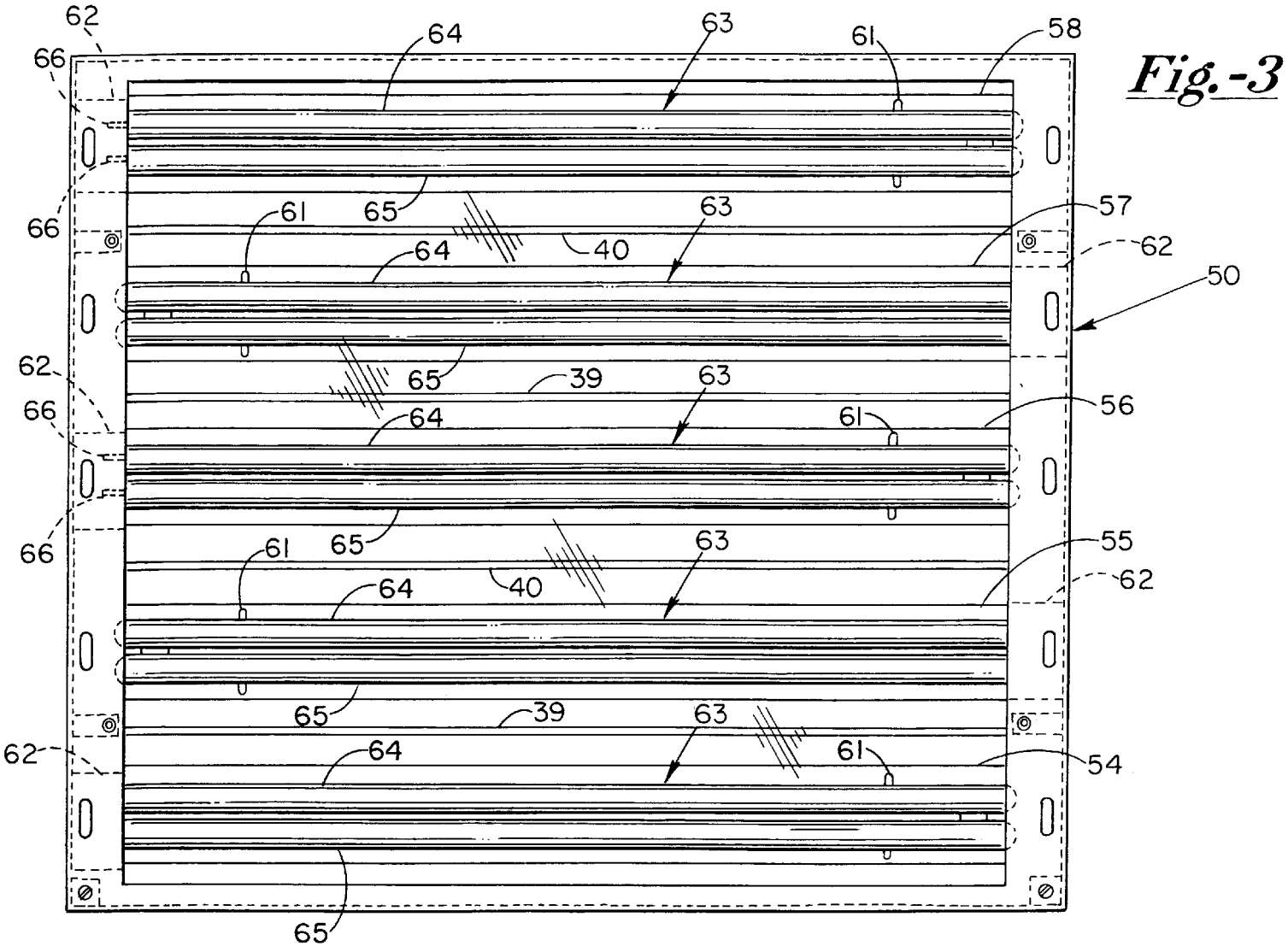
FIG. 3. is a bottom plan view of a bank of my new light reflectors, with the lamps mounted therewithin.
Figure 4:
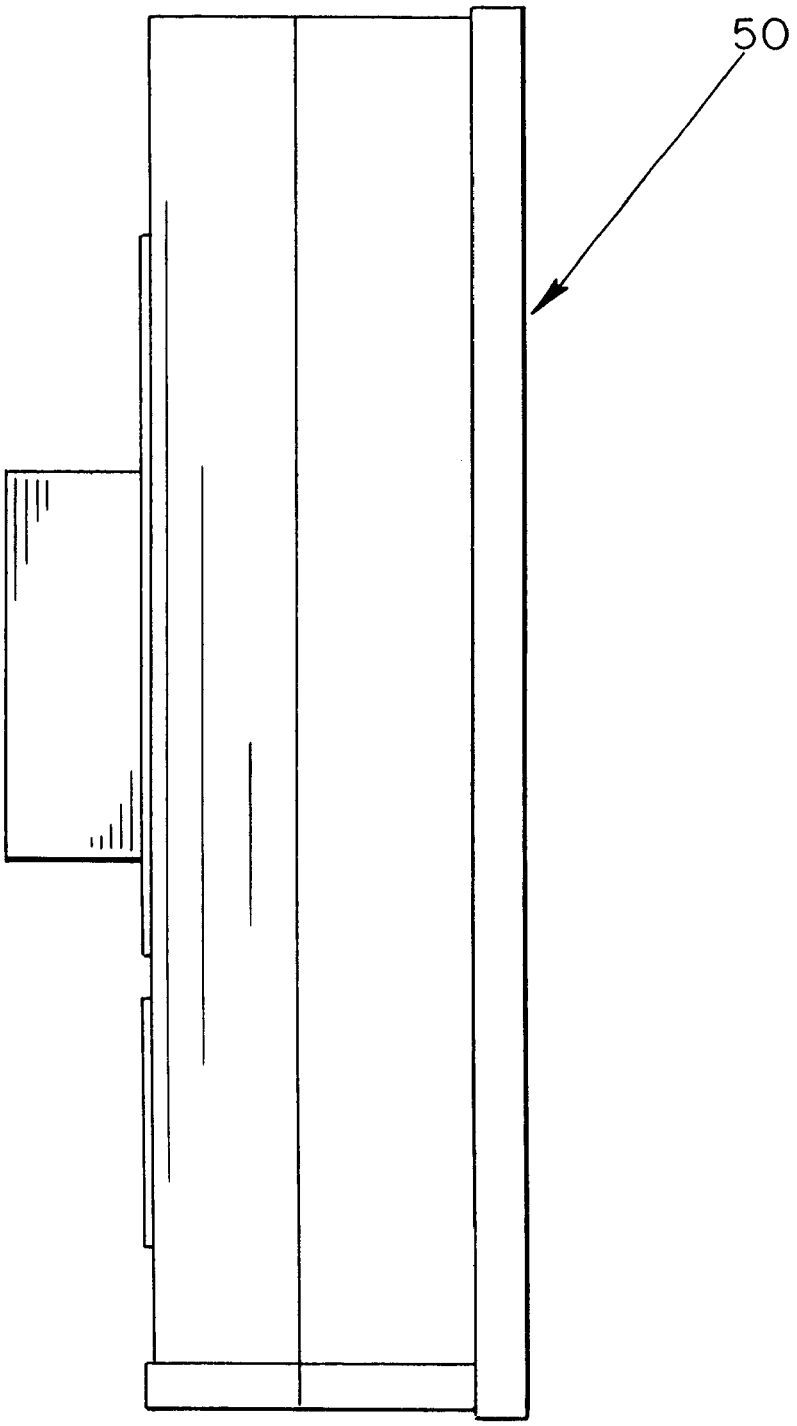
FIG. 4 is a side elevational view of a bank of my new light reflectors.

FIG. 3 shows a bottom plan view of the same five (5) bulb bank of reflectors, with the bulbs in operable positions within the electrically connected receptacles 62. These bulbs 63 are each engaged by its respective receptacle 62 and are comprised of two (2) interconnected tubes, 64 and 65 the ends of which are connected by four (4) lead connectors 66 which includes a filament for activating the mercury and argon within the tube, which in turn illuminates the phosphors which coats the interior of the two (2) tubes. The bulbs which we use in each of the reflectors is a Panasonic bulb, Model No. FPL55E50 55 watt fluorescent bulb, which can be purchased at Denki Corporation of America, 377 Route 17, Suite 118, Hasbrouck Heights, N.J. 07604. Each of the banks of fluorescent lamps referred to herein is equipped with Panasonic lamps of the above type.

The ballasts which we use can also be purchased from the above Denki Corporation of America. Ballasts 51 is electrically connected to the bulb which is the middle bulb and is mounted in the receptacle 62 of the middle reflector 56.

Ballast 52 is electrically connected to the two (2) bulbs shown at the bottom of FIG. 3. It delivers 82.4 wattage, 41.2 watts to each of its bulbs.

Ballast 53 is electrically connected to the two (2) bulbs shown at the top of FIG. 3. It also delivers 82.4 wattage, 41.2 watts to each of the bulbs to which it is connected.

In addition to the benefits described hereinabove, I find that when I place the fixtures described above in position, such as in a square arrangement, with a bank at each corner of the square, and each bank is spaced twenty (20) feet away from the other corner, center to center, and is electrically connected to the ballasts as described hereinabove so that each bulb receives 41.2 watts of current, and the banks are each in an elevated position of about 32 feet, we provide a comfortable, even illumination of the entire area being lighted, while effecting a savings in energy costs of 35–75% and increasing the efficiency by 10%. In addition, we find that this arrangement provides an increase of three (3) foot-candles of lighting at 1–10 foot work levels. These figures have been determined by measurements made at our request by Lighting Services, Inc., 7830 East Evans Road, Scottsdale, Ariz., U.S.A. 85260-3412 in Certified Test Report No. LS113711 and were determined in accordance with current IES published procedures. For large areas, we position a plurality of such squares adjacent each other to form a huge rectangle or square, as the case may be.

The three (3) ballasts described above deliver a total wattage of 206–207 to the five (5) bulbs of each bank, whereas conventional wattage of 300 is utilized in prior existing comparative fluorescent installations. Thus, it can be readily seen that a substantial savings is being effected by the particular combination of fluorescent bulbs and ballasts, as defined above. In addition, this new combination substantially reduces the serious burn-out problem being experienced by competitive fluorescent installations. It is readily apparent that the use of a transformer within the electric circuit materially reduces the rate of burn-out of the bulbs in such fluorescent light installations. This combination causes the lamps to burn cooler and prevents them from burning-out prematurely.

It will, of course, be understood that various changes may be made in the form, details, arrangement and proportions of the parts without departing from the scope of the invention which comprises the matter shown and described herein and set forth in the appended claims.

What is claimed is:

1. A lighting assembly comprising the combination of:

a. a reflector for fluorescent lights comprised of an elongated channel member which is of generally inverted U-shape in cross-sectional configuration, and has an inner surface which has light-reflecting qualities;

b. means for mounting at least one 55-watt fluorescent lamp within the confines of said inverted U-shaped channel member; and c. a hybrid magnetic-electronic ballast electrically connected to said lamp to uniformly provide same with about 41-watts of electric power to illuminate same while running cooler, and to cause said lamp to run for a longer life term.

2. The combination claimed in claim 1, wherein said hybrid magnetic-electronic ballast includes a transformer.

3. The combination claimed in claim 1, wherein the magnetic aspect of said ballast is provided by a transformer.

4. The combination defined in claim 1, wherein said channel member includes a plurality of parallel reflector panels which are interconnected to cooperatively define its shape, and which extend at an angle to each other to produce overlapping beams of reflected light.

5. The combination defined in claim 1, wherein said hybrid ballast is capable of transmitting about 41 watts of electric current into said lamp.

6. A lighting assembly comprising the combination of:

a) a reflector for fluorescent lights comprised of an elongated channel member which is of generally inverted U-shape in cross-sectional configuration and has an inner surface which has light-reflecting qualities, said channel member being further comprised of:

(i) a plurality of adjacent, elongated and interconnected flat reflector panels facing downwardly and cooperatively defining said generally U-shaped configuration;

(ii) each of said reflector panels having a light-reflecting surface facing downwardly and outwardly from said inverted U-shaped member;

b) means for mounting a plurality of 55-watt fluorescent lamps within the confines of said inverted U-shaped channel member; and c) a hybrid magnetic-electronic ballast electrically connected to at least one of said lamps to uniformly provide same with about 41-watts of electric power to illuminate same while running cooler and to cause said lamp to run for a longer life-term.

7. A method for preventing an early burn-out of fluorescent lamps comprising the steps of:

a) providing at least one 55-watt fluorescent lamp;

b) electrically connecting said lamp to a hybrid magnetic-electronic ballast capable, when connected to a source of power, of transmitting about a 41 watt current to that fluorescent lamp.

8. A method of preventing an early burnout of fluorescent lamps comprising the steps of:

a) mounting at least one 55-watt fluorescent lamp for illumination; and b) electrically connecting said lamp to a magnetic-electronic ballast which transmits about a 41-watt current to said lamp.

9. A method of preventing an early burnout of fluorescent lamps comprising of steps of:

a) providing a 55-watt fluorescent lamp; and b) electrically connecting the lamp to a hybrid magnetic-electronic ballast transmitting about a 41-watt current.

10. A lighting assembly comprising the combination of:

a) means mounting at least one 55-watt fluorescent lamp for illumination; and b) a magnetic-electronic ballast electrically connected to said lamp, said ballast transmitting about a 41-watt electric current to said lamp.

11. A lighting assembly comprising the combination of:

a) a 55-watt fluorescent lamp; and b) a magnetic-electronic ballast electrically connected to said lamp and transmitting about a 41-watt current thereto.

* * * * *